US006176482B1

(12) United States Patent
Reinhard et al.

(10) Patent No.: US 6,176,482 B1
(45) Date of Patent: Jan. 23, 2001

(54) SHEET-GUIDING SUCTION BOX

(75) Inventors: Gerald Josef Reinhard, Sulzfeld; Johannes Georg Schaede, Würzburg, both of (DE)

(73) Assignee: Koenig & Bauer Aktiengesellschaft, Wurzburg (DE)

( * ) Notice: Under 35 U.S.C. 154(b), the term of this patent shall be extended for 0 days.

(21) Appl. No.: 09/147,087

(22) PCT Filed: Apr. 1, 1997

(86) PCT No.: PCT/DE97/00656

§ 371 Date: Oct. 2, 1998

§ 102(e) Date: Oct. 2, 1998

(87) PCT Pub. No.: WO97/36813

PCT Pub. Date: Oct. 9, 1997

(30) Foreign Application Priority Data

Apr. 2, 1996 (DE) ..... 196 13 084

(51) Int. Cl.[7] ..... B65H 7/02

(52) U.S. Cl. ..... 271/227; 271/183; 271/231

(58) Field of Search ..... 271/183 C, 231 C, 271/227 O, 271

(56) References Cited

U.S. PATENT DOCUMENTS

| | | | | |
|---|---|---|---|---|
| 2,572,640 | | 10/1951 | Lovegrove . | |
| 3,724,940 | * | 4/1973 | Koizumi | 355/3 R X |
| 4,173,301 | | 11/1979 | Turini . | |
| 4,712,009 | * | 12/1987 | Ohgoda et al. | 250/327.2 X |
| 4,721,462 | | 1/1988 | Collins, Jr. . | |
| 4,990,793 | * | 2/1991 | Bonigk | 250/571 X |
| 5,329,852 | | 7/1994 | Bolza-Schünemann . | |

FOREIGN PATENT DOCUMENTS

| | | |
|---|---|---|
| 2023547 | 1/1980 | (GB) . |
| 2071063 | 9/1981 | (GB) . |

* cited by examiner

*Primary Examiner*—Christopher P. Ellis
*Assistant Examiner*—Kenneth W Bower
(74) *Attorney, Agent, or Firm*—Jones, Tullar & Cooper PC

(57) ABSTRACT

A sheet-guiding suction box can be adapted to the size or format of a plurality of sizes of sheets to be guided. This is accomplished by structuring the guide box with a plurality of independently acting suction chambers. A central suction area of the guide surface of the suction box is smaller in size than the smallest format of a sheet to be guided.

8 Claims, 4 Drawing Sheets

SHEET-GUIDING SUCTION BOX

FIELD OF THE INVENTION

The present invention relates to a suction box for guiding sheets. This suction box has a plurality of individually acting suction chambers. A central one of these is smaller than the smallest sheet to be guided and is comprised of two individual chambers.

DESCRIPTION OF THE PRIOR ART

U.S. Pat. No. 2,572,640 describes a suction box for holding films in a central suction chamber, whose extension is less than the smallest format of a film to be held.

It is disadvantageous in connection with this suction chamber that the vacuum collapses in case of a partial coverage, such as occurs in particular in connection with moving sheets, so that the dependable suction of the moved sheet is not assured.

SUMMARY OF THE INVENTION

It is object of the present invention to produce a suction box for guiding sheets.

This object is attained in accordance with the invention by the provision of a suction box that is used to guide a variety of sizes of sheets. The suction box is formed having a plurality of independently acting suction chambers. At least one central suction chamber is arranged so that its extension is less than the smallest size of a sheet to be guided. Two independently acting suction chambers form this central suction chamber.

The suction box in accordance with the present invention can be adapted, in an advantageous manner, to the format of various sized sheets. The effects of secondary air are prevented by this, and an even suction force is achieved, even with formats of different size. With large formats, corners and edges have a greater tendency to flutter. To prevent the fluttering of corners, suction chambers which can be independently controlled are provided there.

It is particularly advantageous to employ this suction box in connection with inspection systems, because it is necessary, in connection with inspection systems, to guide sheets to be inspected steadily and flutter-free at least during the image recording. This is not absolutely necessary in remaining areas of a sheet transport path, so that the increased technical outlay for flutter-free guidance can be avoided.

It is possible by means of an integrated sensor, which is displaceable in the transport direction, to trigger the image recording, in such a way that during the recording the sheet is centered in relation to a CCD area camera of the inspection system.

BRIEF DESCRIPTION OF THE DRAWINGS

The device of the present invention is represented in the drawings and will be described in greater detail in what follows.

Shown are in.

DESCRIPTION OF THE PREFERRED EMBODIMENT

Figure 1:
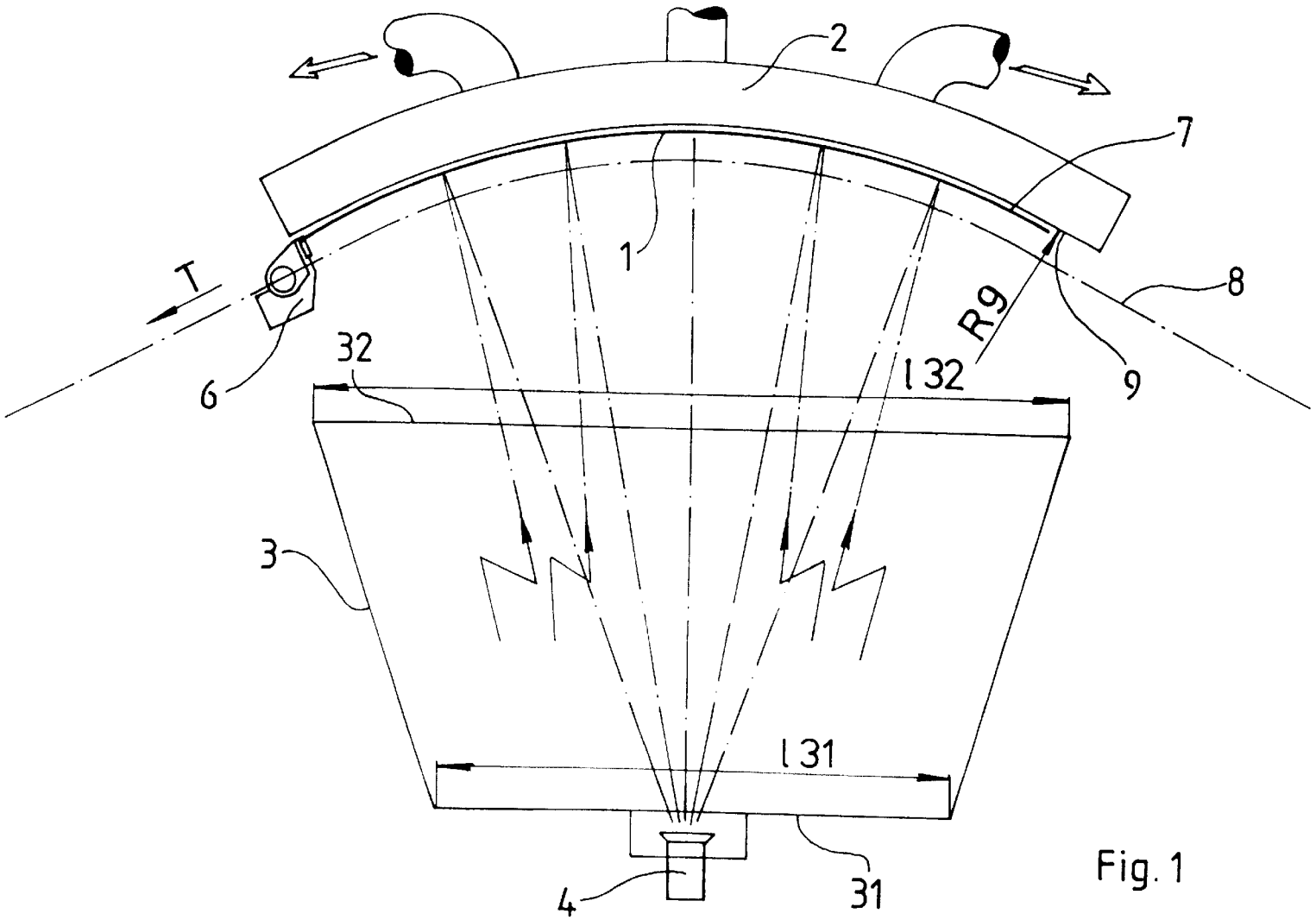
FIG. 1, a schematic lateral view of a device for the qualitative assessment of printed sheets, FIG. 2, a schematic plan view of a device for the qualitative assessment in the transporting direction of the printed sheets, FIG. 3, a schematic view from above on a suction box of the device for the qualitative assessment of printed sheets, FIG. 4, a perspective plan view of the device.

A device for the qualitative assessment of processed material 1 is shown in FIG. 1 essentially consists of a material guide 2, an illuminating device 3, at least one sensor 4 and a downstream connected evaluation device.

This quality control system can be employed for monitoring of processed materials such as both webs and sheets 1 in a rotary printing press or a machine for further processing. In the present preferred embodiment, the quality control system is employed in a sheet-fed rotary printing press for the qualitive assessment of processed materials such as stocks and bonds, and in particular, for banknotes.

Figure 3:
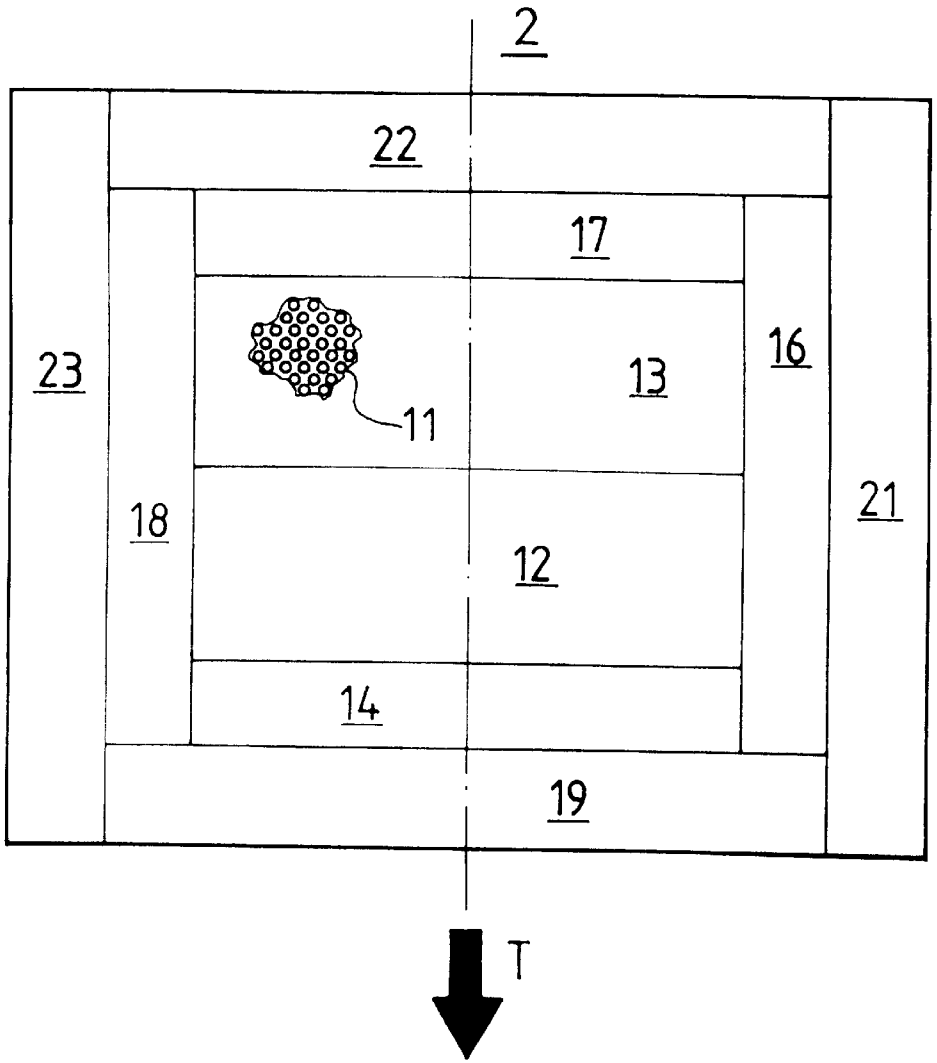

For example, sheets 1 to be inspected are conveyed by means of gripper systems 6 on a sheet transport level 7. These gripper systems 6 are fastened to circulating chains 8 of a chain conveyor, which is known per se. The material guide 2 is arranged above the sheet transport level 7. This guide 2 has a shape which, for example, is curved in the transport direction T on its guide surface 9 facing the sheets 1. This guide surface 9 therefore is concavely curved in the transport direction T and has a radius of curvature R9, for example R9=800 mm. The material guide 2 is embodied as a suction box 2, for example. To this, end the guide surface 9 is provided with a plurality of perforations 11, i.e. the guide surface 9 is constituted by a perforated plate as seen in FIG. 3. The perforations 11 each may have a diameter of 2 mm, for example, and may be spaced from each other in a grid at a distance of 3 mm. This guide surface 9 is arranged to be interchangeable with other guide surfaces having different perforations and can be folded down for maintenance work.

Separating walls are arranged inside the suction box 2, so that a number of suction chambers 12, 13; 14, 16, 17, 18; and 19, 21, 22, 23 are formed, which acts independently and which are separately controllable. An area in the center of the suction box 2 which approximately corresponds to the smallest format of the sheets 1 to be guided is divided in the transport direction T into a front central suction chamber 12 and a rear central suction chamber 13. Respective intermediate suction chambers 14, 16, 17, 18 adjoin the four sides of this central rectangular area 12, 13. Again, four peripheral suction chambers 19, 21, 22, 23 are arranged next to exemplary of these interchangeable suction chambers 14, 16, 17, 18 in the direction of outside edges of the sheet 1. The outermost suction chambers 21, 23 extending in the transport direction T can be once again be divided.

A vacuum in each of the individual suction chambers 12, 13; 14, 16, 17, 18; and 19, 21, 22, 23 can be individually controlled, for example by means of a bypass control. In this way, it is possible to adapt a holding force acting on the sheets 1 to the format, material or type of processing of the sheets, for example.

Figure 2:
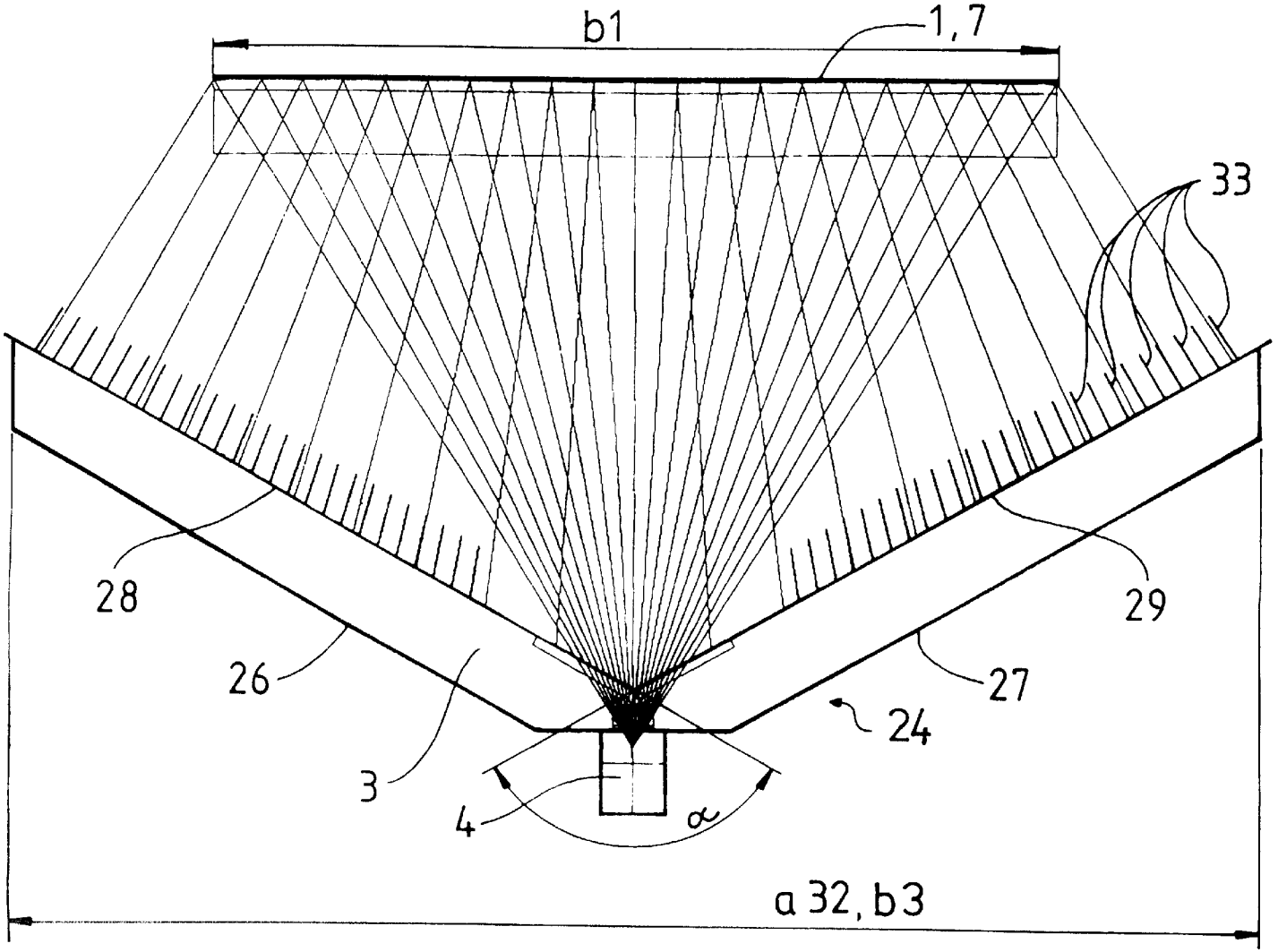

The illuminating device 3 and the sensor 4 are arranged opposite the suction box 2. The illuminating device 3 has a V-shaped cross section in the transport direction T, as seen most clearly in FIGS. 2 and 4 i.e. it is designed as a V-shaped box 24. This box 24 has two legs 26, 27 with level light outlet surfaces 28, 29 facing the sheets to be inspected. These legs 26, 27 include an opening angle alpha of, for example, 122°. This opening angle alpha preferably has a range between 90° to 150°. Each one of the two light outlet surfaces 28, 29 is shaped generally trapezoidally as shown in FIG. 1. Here the shorter ones of the two base sides of each of the two trapezoidally shaped light outlet surfaces 28 and 29 meet and extend parallel in respect to the transport direction T. The two short base sides each have a length 131 of, for example 350 mm. The two larger base sides 32 each have a length 132, for example 132=560 mm, also extend parallel in the transport direction T and are spaced apart transversely to the transport direction T at a distance a32, for example a32=1220 mm, which corresponds to a width b3 of the illuminating device. This distance a32 is greater than a greatest width b1, for example 840 mm, of the sheets 1 to be inspected.

Thus, the size and format of the illuminating device is matched to the format of the sheets 1 to be inspected. The light outlet surfaces 28, 29 consist of panes of frosted glass, for example. A plurality of diffusely radiating light sources have been respectively arranged underneath these frosted glass panels. These light sources are embodied as single flashtubes, for example. A particularly even illumination of the sheets 1 to be inspected is achieved by this arrangement of light sources and frosted glass panes.

In place of the V-shaped cross section, the illuminating device 3 can also have a curved cross section, for example in the shape of an arc of a circle.

Figure 4:
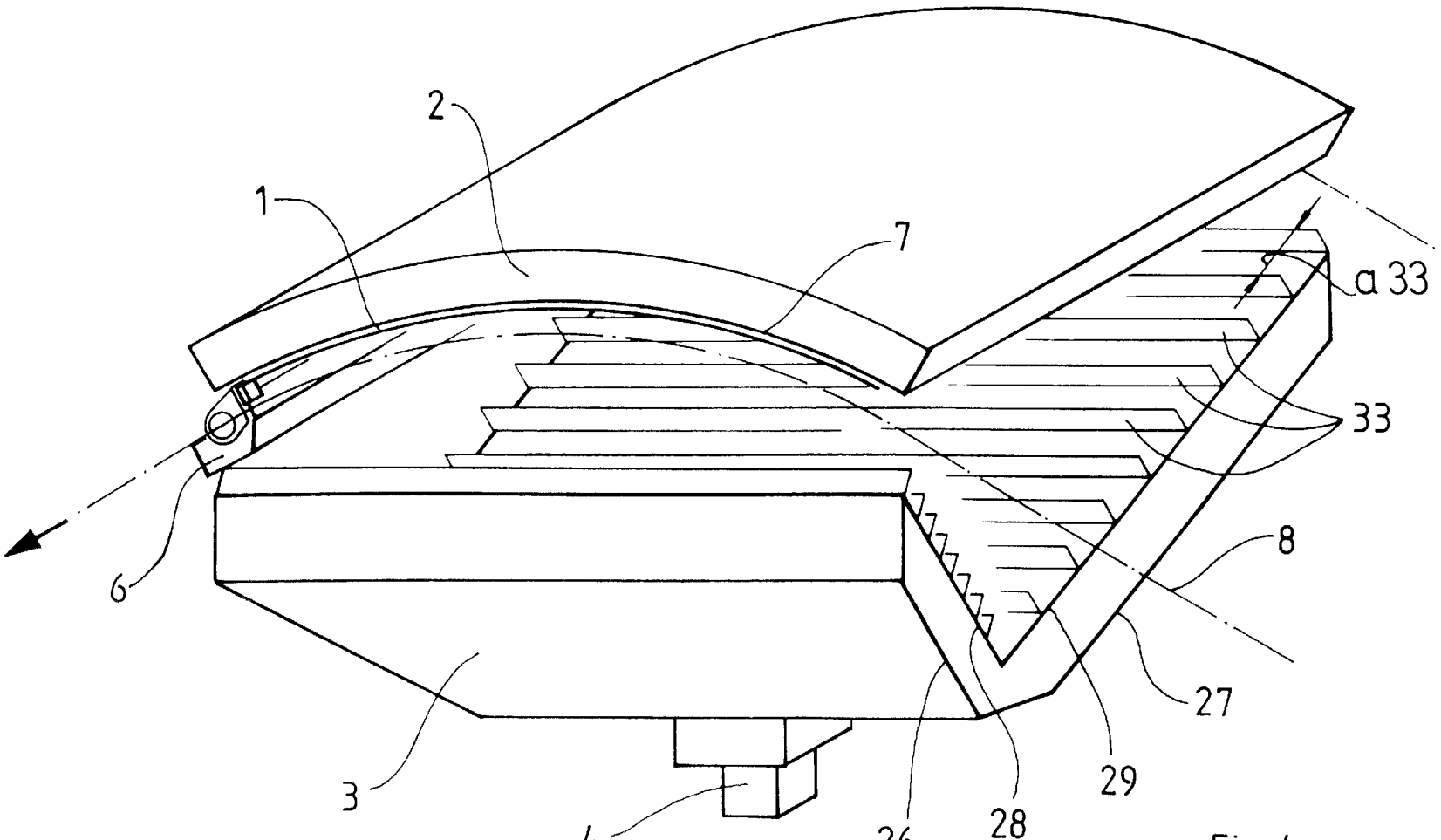

A plurality of guide strips 33 or shutters extending parallel in the transport direction T can, and also be placed on the frosted glass panel. These guide strips 33 are seen in FIGS. 1 and 4 and can be made of sheet metal or also of frosted glass, for example. An angle of inclination of these guide strips 33 in respect to the light outlet surfaces 28, 29, or respectively the sheet transport level 7 is matched to extend parallel with a light beam, wherein such a light beam directed between two guide strips 33 impinges on the sensor 4 after having been reflected on a reflecting area of the sheet 1.

These guide strips 33 have a distance a33, for example a33=20 mm, from each other.

The illuminating device can also consist of several, singly arranged light sources.

The sensor 4 is arranged in the center of this illuminating device 3. In this case, a CCD area camera 4 with a lens fixed in front of it is provided as the sensor 4. In the present embodiment the lens has been designed in such a way that the entire sheet 1 to be inspected is covered, i.e. a distance between the CCD area camera 4 and the sheet transport level 7 is adapted to the lens of the CCD area camera. However, it is also possible to cover several portions individually one after the other and to combine them into a whole image. The sheet 1 to be inspected is located in the optical axis of the objective of the CCD area camera 4.

In the present embodiment a sensor, not represented, which acts as a trigger, has been installed in the suction box. This sensor detects the front edge of the sheet 1 to be inspected and triggers the inspection process. This sensor is arranged displaceably in the transport direction T in order to align the position of the sheet in case of sheet formats of different sizes in such a way that the inspection takes place approximately centered in respect to the lens of the CCD area camera 4.

An evaluation device is connected downstream of the CCD area camera 4.

An image of the sheet 1 to be inspected is divided into a matrix consisting of a multitude of small image elements, i.e. pixels. Each one of these pixels is assigned a defined position by providing its coordinates in the X and Y direction of a Cartesian coordinate system. In-addition, a value Z is assigned to its remission value, for example its gray scale value, which defines the latter. Each pixel $P_i$ ($X_i$, $Y_i$, $Z_i$) is therefore exactly defined in its position and size by the statement of the values $X_i$, $Y_i$, $Z_i$.

The light reflected from the sheet 1 to the individual pixels $P_i$ is converted, corresponding to its strength, by the CCD area camera 4 into an electrical analog signal. This analog signal is supplied to an A/D converter, which forms the digital values $Z_i$ from this. Customarily, and the value range is here divided into 0 to 255 discrete values. In this case, the value 0 means no reflection at all impinging on the corresponding pixel $P_i$ of the CCD area camera 4, while 255 corresponds to a maximum reflection.

In the case of the present application, the sheet 1 to be inspected has reflecting surfaces. In this connection, "reflecting" is understood to mean that light beams impinging on the surfaces are reflected with little scattering and have a noticeably directed portion. Such surfaces can be silver threads in bank notes in particular, or holograms or kinegrams. These reflecting surfaces are to be recognized as such.

A value range is now assigned to the values of the pixels $P_i$ of such a sheet 1 in such a way that the occurring value range outside of the reflecting surfaces clearly lies within the limits 0 to 255. In actual use, for example, the color "white" is assigned a value $Z_i$ from 180 to 200, and the color "black" a value $Z_i$ between 10 and 30.

This assignment is performed, for example, by means of adjusting the brightness of the illuminating device 3, the amplification of the camera signal in the electronic evaluation device, or by the use of a shutter of the lens of the CCD area camera 4.

The sheet 1 is evenly illuminated by means of the illuminating device 3 in such a way that each reflecting surface located at any arbitrary place on the sheet 1, which has almost ideal reflective properties, reflects an incident light beam directly into the CCD area camera 4. At least partially directed light beams are used for this. The associated value $Z_i$ of a pixel $P_i$ assumes a value upon reflection, which clearly differs from a value assigned to the color "white". For example, in that case the value $Z_i$ of a pixel $P_i$ assigned to a reflecting surface then reaches 230 to 255.

In this way, and areas with reflecting surfaces are clearly defined by means of the association of extreme values $Z_i$, i.e. area which weakly scatter and which thus are provided with clearly directed reflective portions are differentiated from areas with diffuse reflection.

The pixels assigned to the reflecting surfaces are then recognized as such by the electronic evaluation device and are further processed accordingly.

While a preferred embodiment of a sheet-guiding suction box in accordance with the present invention has been set forth fully and completely hereinabove, it will be apparent to one of skill in the art that a number of changes in, for example the type of press used to accomplish the printing of the sheets, the source of supply of the suction to the suction box and the like could be made without departing from the true spirit and scope of the present invention which is accordingly to be limited only by the following claims.

What is claimed is:

1. A guide for sheets comprising:

a suction box;

a plurality of independently acting suction chambers in said suction box, said plurality of independently acting suction chambers including two central suction chambers, and defining a guided surface, said guide surface being curved in a transport direction of sheets to be guided;

a central suction area of said plurality of independantly acting suction chambers, said central suction area being formed by said two central suction chambers of said plurality of independantly acting suction chambers and having a length less than a smallest sheet to be guided; and an inspection system for qualitative assessment of sheets to be guided, said suction box being located opposed to said inspection system.

2. The suction box of claim 1 further comprising at least first and second peripheral suction chambers bounding said two central suction chambers of said plurality of independantly acting suction chambers.

3. The suction box of claim 2 wherein said first and second peripheral suction chambers extend in the transport direction of sheets to be guided.

4. The suction box of claim 2 wherein said first and second peripheral suction chambers extend transverse to the direction of transport of sheets to be guided.

5. The suction box of claim 1 further including means for controlling a suction supply to each of said plurality of independently acting suction chambers.

6. The suction box of claim 1 wherein said guide surface is interchangeable.

7. A guide for sheets comprising:

a suction box;

a plurality of independantly acting suction chambers in said suction box, said plurality of independantly acting suction chambers including two central suction chambers and defining a guide surface, said guide surface being curved in a transport direction of sheets to be guided; and a central suction area of said plurality of independantly acting suction chambers, said central suction area being formed by said two central suction chambers of said plurality of independantly acting suction chambers and having a length less than a smallest sheet to be guided.

8. A guide for sheets comprising:

a suction box;

a plurality of independantly acting suction chambers in said suction box, said plurality of independantly acting suction chambers including two central suction chambers and defining a guide surface;

a central suction area of said plurality of independantly acting suction chambers, said central suction area being formed by said two central suction chambers of said plurality of independantly acting suction chambers and having a length less than a smallest sheet to be guided; and an inspection system for qualitative assessment of sheets to be guided, said suction box being located opposed to said inspection system.

* * * * *